United States Patent [19]

Devaud

[11] 4,413,547

[45] Nov. 8, 1983

[54] SERVO-CONTROL DEVICE FOR AIRCRAFT FLIGHT CONTROL

[75] Inventor: Gérard L. Devaud, Paris, France

[73] Assignee: Societe d'Applications des Machines Motrices, Issy-les-Moulineaux, France

[21] Appl. No.: 227,118

[22] Filed: Jan. 21, 1981

[30] Foreign Application Priority Data

Jan. 25, 1980 [FR] France ..... 80 01591

[51] Int. Cl.[3] ..... F01B 15/00; F15B 9/10

[52] U.S. Cl. ..... 91/216 R; 91/216 A; 91/384

[58] Field of Search ..... 91/216 A, 216 R, 384, 91/216 B; 92/117 R, 117 A

[56] References Cited

U.S. PATENT DOCUMENTS

| | | | |
|---|---|---|---|
| 284 | 1/1877 | Hodson | 91/216 R |
| 2,943,606 | 7/1960 | Willis et al. | 91/216 A |
| 3,122,972 | 3/1964 | Rasmussen | 91/216 A |
| 3,158,068 | 11/1964 | Bokelmon | 91/216 A |
| 3,295,420 | 1/1967 | Gleason | 91/216 R |

*Primary Examiner*—Paul E. Maslousky

*Attorney, Agent, or Firm*—Sughrue, Mion, Zinn, Macpeak and Seas

[57] ABSTRACT

The device comprises a directional valve body which is movable with respect to guide means, and a spool which is slidably mounted in the body and connected to a control lever. The latter is pivotally mounted on a pin which is fixed relative to the body. This pin is carried by a support which is mounted on the body and means are provided for adjusting the position of the support relative to the body.

4 Claims, 1 Drawing Figure

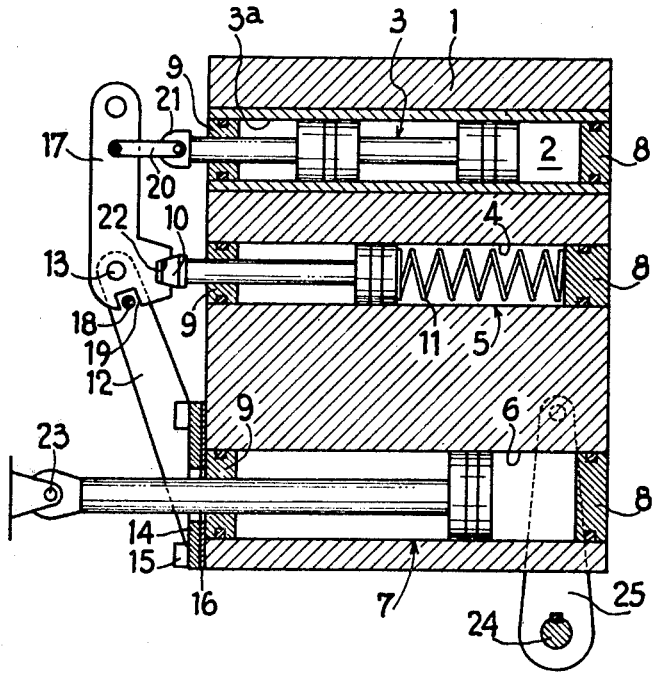
3a
3
1
9
21
17
20
2
8
22
10
4
13
8
18
9
11
5
19
12
9
6
23
8
14
15
16
7
25
24

SERVO-CONTROL DEVICE FOR AIRCRAFT FLIGHT CONTROL

DESCRIPTION

The present invention relates to a servo-control device of the type comprising a directional valve body which is movable with respect to guide means and a spool mounted in the body and connected to a control lever which is mounted to pivot about a pin which is fixed relative to the body, said pin being carried by a support mounted on the body. British Pat. No. 724,750 discloses a device of this type. The invention concerns in particular devices of this type employed for the flight control of aircraft.

In known servo-control devices (see for example French Pat. No. 2 090 281), the spool is adjusted in position by means of mechanical precision devices such as eccentrics and screw and nut systems which vary the position of the spool or the position of the sleeve therefore relative to the body of the device.

An object of the invention is to take advantage of the use of a pivot support mounted on the body as described in the aforementioned British Pat. No. 724,750 so as to obtain an easier, cheaper and more reliable adjustment of the neutral position of the spool.

The invention consequently provides a servo-control device of the aforementioned type, wherein means are provided for adjusting the position of the support with respect to the body.

Thus, the adjustment of the neutral position of the spool can be very easily achieved by adjusting the position of the support with respect to the body. Preferably, for this purpose, there is employed a set of shims forming spacer members, the shim of suitable thickness being interposed between the support and the body. No accidental disadjustment is then possible.

The particular structure of the device according to the invention may also be taken advantage of by constructing the body from a blank obtained by cutting to length a section member provided with a plurality of longitudinally extending parallel passageways receiving the active component parts of the device.

Another object of the invention is to provide a flight control apparatus for an aircraft which comprises a servo-control device such as that defined hereinbefore and comprises in addition means for locking the lever with respect to the body which are biased by a spring toward their locking position and are adapted to be shifted from said position by the pressure of the fluid actuating the device.

Further features and advantages of the invention will be apparent from the ensuing description which is given merely by way of example with reference to the accompanying drawing in which the single FIGURE represents diagrammatically a servo-control device according to the invention.

The servo-control device illustrated in the drawing comprises a directional valve body 1 which has a constant cross-sectional shape and is provided, throughout its length, with three cylindrical parallel longitudinally extending passageways, namely a passageway 2 in which a spool 3 is mounted and which has a sleeve 3*a*, a passageway 4 forming the body of a single-acting cylinder device 5, and a passageway 6 forming the body of a double-acting cylinder device 7. Pipes (not shown) for the circulation of fluid suitably connect the passageways 2, 4 and 6 to each other, to a source of hydraulic fluid under pressure and to a sump (not shown).

The body 1 is constructed by machining a blank obtained in the following manner. A section member or shape is produced in a draw die so as to have throughout its length the passages 2, 4 and 6 and is thereafter cut into sections so as to form a series of blanks.

Each of the passageways 2, 4 and 6 has at one end (the right end as viewed in the drawing) a plug 8 and, at its opposite end, a plug 9 provided with a centre aperture. The rod for shifting the spool 3 extends through the plug 9 of the passageway 2 which has a sealing element. Likewise, the piston rods of the cylinder device 5 and cylinder device 7 extend through the plugs 9 of the passageways 4 and 6 respectively, these plugs having a sealing element interposed therebetween and the piston rods.

The piston rod of the cylinder device 5 carries at its free end a frustoconical lock or stop 10 and is biased out of the passageway 4 by the action of a coil spring 11 which is compressed between the piston of this cylinder device and the corresponding plug 8.

Fixed on the end surface of the body 1 which is adjacent the plugs 9 is an oblique support or bracket 12 in the shape of a fork carrying a transverse pin 13 adjacent the free end thereof. The base 14 of this support 12, which is in the shape of a plate, is fixed to the body 1 by screws 15 with interposition of a shim or spacer member 16 of constant thickness.

A control lever 17 is pivotally mounted at one end on the pin 13 and pivotally connected at the other end thereof to an actuating linkage (not shown). The lever 17 is free to rotate to a small angular extent determined by a stud 18 carried by the support 12 and received with a slight clearance in a notch 19 in the lever 17.

An intermediate point of the lever 17 is connected by a connecting rod 20 to a yoke 21 carried by the free end of the rod of the spool 3 and, at another intermediate point of this lever, the latter has a frustoconical cavity 22 the shape of which corresponds to the shape of the lock 10 and is located on the axis of the cylinder device 5.

When the lock 10 enters the cavity 22, it locks the lever 17 in a position in which the stud 18 is centered in the notch 19. The replacement of the shim 16 by a similar shim which has a different thickness consequently moves the lever 17 in translation with respect to the body 1 to an extent which is equal to the difference between the thicknesses of the two shims. The choice of a suitable shim from a set of shims of different thicknesses is thus sufficient to adjust correctly the neutral position of the spool 3 with respect to the sleeve 3*a* in which it slides. This adjustment is very simple and, once made, it cannot be accidentally modified.

In operation, the piston rod of the cylinder device 7 is for example pivotally mounted at a fixed point 23 adjacent the end of the body 1 so that the latter is movable in translation along this rod. The body 1 is moreover connected to an element to be controlled, for example to a shaft 24, through a cranked arm 25 keyed on this shaft.

The chamber of the cylinder device 5 opposed to the spring 11 is connected to the source of fluid under pressure. In operation, the pressure causes the withdrawal of the lock 10, and consequently the release of the lever 17, as soon as it reaches a value much less than the value which causes the displacement of the spool 3 for the purpose of shifting the body 1 in the desired direction.

In the event of failure of the hydraulic circuit, the spring 11 shifts the lock 10 which locks the lever 17 in the illustrated position and renders the latter rigid with the body 1. Any action on the lever 17 then causes the direct displacement of the body 1 in the same direction. This double possibility of controlling or shifting the body 1, in an assisted manner and in a direct manner, renders the device perfectly reliable and enables it to be employed for the control of vital elements of aircraft, for example the main rotor of a helicopter or the aileron of a light aircraft.

However, it must be understood that the device is applicable to simpler servo-control devices having no lock and intended for other applications. The device according to the invention may moreover comprise a rotary and not a sliding spool and the body 1 may be guided and connected to the element to be controlled by means other than those illustrated.

Having now described my invention what I claim as new and desire to secure by Letters Patent is:

1. A flight control apparatus for an aircraft comprising: a directional valve having a body and a spool mounted in a longitudinal passageway in the body for axial, bidirectional movement relative to a neutral position of the spool, fixedly mounted guide means cooperative with the body for guiding the body which is movable relative to said guide means, a support mounted on the valve body and stationary with respect thereto, a pivot pin carried by the support, said pivot pin being stationary with respect to the valve body, a control lever pivotally mounted on the pin for limited angular displacement about an axis defined thereby, said axis being stationary with respect to the valve body, means connecting the spool to the lever, and a shim forming a spacer member interposed between the support and the valve body for adjustably fixing the stationary position of the support with respect to the body to thereby enable the facile adjustment of the neutral position of the spool.

2. An apparatus according to claim 1, wherein the valve body has a plurality of further longitudinal passageways, wherein said spool passageway and said further passageways are parallel and extend completely through said body for providing the valve body with a constant cross-sectional area throughout, and wherein said guide means and an additional active component of the apparatus are individually disposed in said further passageways.

3. A flight control apparatus for an aircraft, said apparatus comprising in combination: a fluid-actuated servo-control device comprising a directional valve having a body and a spool mounted in a longitudinal passageway in the body for axial, bidirectional movement relative to a neutral position of the spool, fixedly mounted guide means cooperative with the body for guiding the body which is movable relative to said guide means, a support mounted on the valve body and stationary with respect thereto, a pivot pin carried by the support, said pivot pin being stationary with respect to the valve body, a control lever pivotally mounted on the pin for limited angular displacement about an axis defined thereby, said axis being stationary with respect to the valve body, means connecting the spool to the lever, a shim forming a spacer member interposed between the support and the valve body for adjustably fixing the stationary position of the support with respect to the body to thereby enable the facile adjustment of the neutral position of the spool, movable locking means for locking the lever with respect to the body, a spring cooperative with the locking means for biasing the locking means to a lever locking position of the locking means, and means adapted to be actuated by fluid pressure for moving the locking means away from said lever locking position.

4. An apparatus according to claim 3, wherein said guide means comprises a cylinder device having a piston rod, the body being slidable on the piston rod and connected to an element to be controlled.

* * * * *